US005749204A

United States Patent [19]

Bokelmann et al.

[11] Patent Number: 5,749,204

[45] Date of Patent: May 12, 1998

[54] BULK CHEESE TRANSFER AND CONTAINERIZING SYSTEM

[75] Inventors: Paul R. Bokelmann, Fond du Lac; Thomas R. Schumacher, Marshall; Arvid E. Winberg, Fond du Lac, all of Wis.

[73] Assignee: Damrow Company, Inc., Fond du Lac, Wis.

[21] Appl. No.: 712,054

[22] Filed: Sep. 10, 1996

[51] Int. Cl.[6] ..... B65B 3/04; B65B 25/06

[52] U.S. Cl. ..... 53/471; 53/175; 53/243; 53/449; 53/518; 426/130

[58] Field of Search ..... 53/243, 242, 449, 53/175, 471, 467, 473, 518, 536; 426/130, 582; 99/458

[56] References Cited

U.S. PATENT DOCUMENTS

| | | | |
|---|---|---|---|
| 3,969,995 | 7/1976 | Krueger et al. | 99/458 |
| 4,226,170 | 10/1980 | Christensson | 53/175 X |
| 4,723,935 | 2/1988 | Furukawa | 53/175 X |
| 4,918,906 | 4/1990 | Ako | 53/175 X |
| 5,146,845 | 9/1992 | Pittelko | 99/454 |
| 5,165,218 | 11/1992 | Callahan, Jr. | 53/243 X |
| 5,175,014 | 12/1992 | Brockwell et al. | 426/582 |
| 5,209,943 | 5/1993 | Pittelko | 426/582 |
| 5,243,900 | 9/1993 | Pittelko | 99/461 |
| 5,324,529 | 6/1994 | Brockwell | 53/518 X |
| 5,428,938 | 7/1995 | Davis | 53/175 X |

*Primary Examiner*—James F. Coan
*Attorney, Agent, or Firm*—Andrus, Sceales, Starke & Sawall

[57] ABSTRACT

A process for the final containerization of bulk cheese discharged from a vertical cheese forming tower operates with variant methods to accommodate direct filling of the final container or preliminary filling for transfer to the final container. In accordance with both methods, initial filling utilizes a false bottom container which allows the cheese section to be lowered into the container for sealing and either final closure or inversion and transfer to another final container such as a fixed bottom steel barrel. Both methods utilize a step of placing a closure over the open top of the initially filled container, and an inverting step to expose the opposite end of the container for a final closure. Common apparatus may be used in the system of the present invention to accommodate either embodiment of the containerization method.

24 Claims, 9 Drawing Sheets

FIG. 11
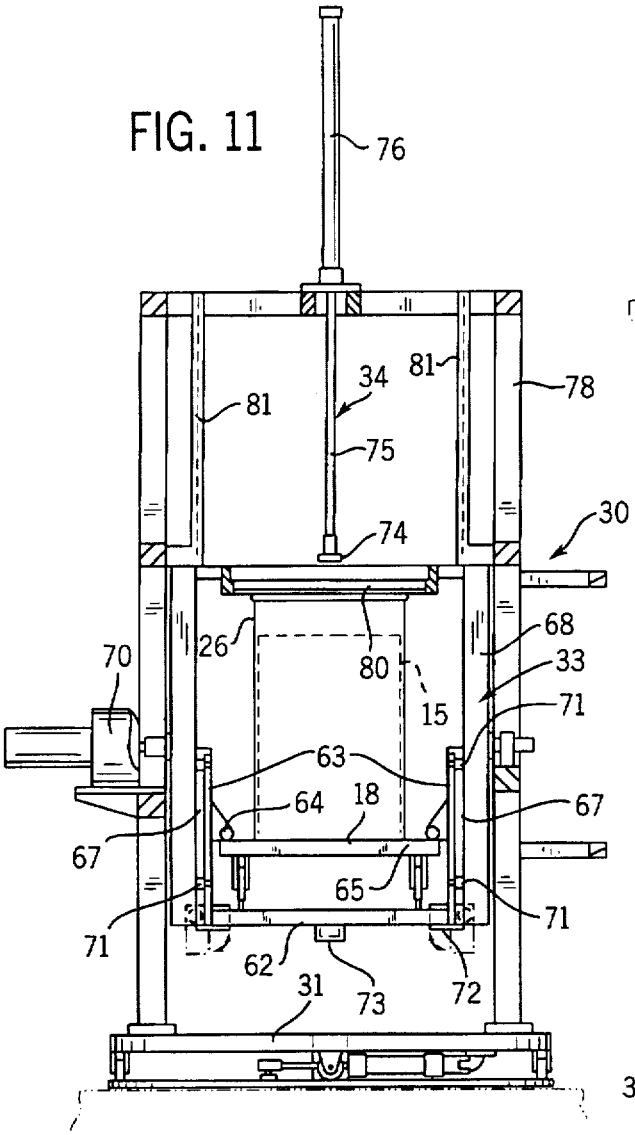
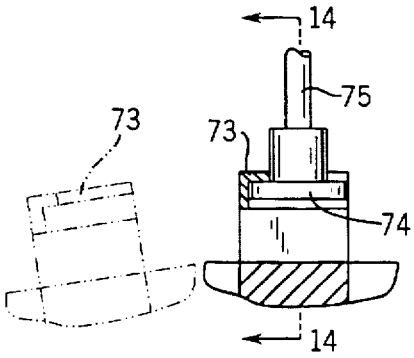
FIG. 13
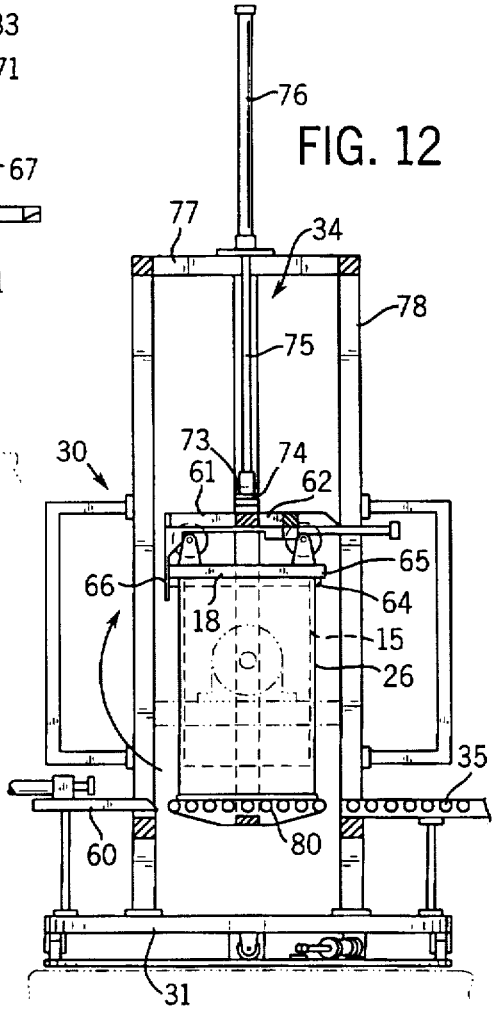
FIG. 12
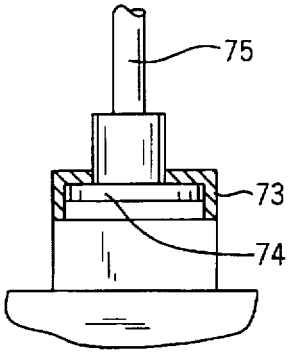
FIG. 14

BULK CHEESE TRANSFER AND CONTAINERIZING SYSTEM

BACKGROUND OF THE INVENTION

The present invention pertains to a method and apparatus for handling bulk cheese which is continuously formed and, more particularly, to a system for containerizing bulk cheese from a vertical cheese forming tower.

Cheese towers are commonly used for the large volume production of cheese on a continuous basis. Cheese towers are particularly attractive because they may be used to produce rectangular blocks packaged in rectangular containers or cylindrical blocks for packaging in corresponding cylindrical barrels. Conventional 640 lb. blocks are one form of bulk cheese which can be made in a vertical tower and 500 lb. cylindrical size for barrels is another. A continuous vertical cheese former is shown in U.S. Pat. No. 5,146,845 and a process for making bulk cheese in a vertical former is described in U.S. Pat. No. 5,209,943.

Vertical cheese towers are also attractive because the cheese product exiting the bottom of the tower may be substantially dewatered (i.e. dewheyed) such that it is ready for direct bulk packaging and shipment. A variety of systems and methods have been devised for transferring bulk cheese from a vertical cheese former into the container for shipment. One of the basic problems which must be addressed and solved in the vertical bulk cheese transfer and containerization process is to hold the shape of the cheese as it is discharged from the tower and being transferred into a container. The cheese at this point is still in a semi-fluid state, even though substantially dewatered, and will typically flow to fill the space in which it is confined or into which it is transferred. Thus, the bulk cheese transfer and containerization processes and apparatus have typically sought to maintain some sort of vertical and lateral restraint on the rectangular or circular block of cheese exiting the bottom of the tower, utilizing direct transfer into the container while maintaining substantial restraint against vertical and lateral flow.

Variations in tower processing conditions may result in a cheese from which greater amounts of whey have been extracted. The resulting continuously formed cheese will be significantly more dry and, though not tending to flow as would cheese with a higher moisture content, the drier cheeses tend to crumble and fall apart. Therefore, this type of cheese also presents difficult handling problems. These problems are all exacerbated when the tower is utilized to produce large bulk quantities in, for example, 640 lb. block and 500 lb. barrel sizes.

A bulk cheese transfer system from a forming tower is shown in U.S. Pat. No. 5,243,900. In this patent, an intermediate cylindrical clamping sleeve holds a cylindrical section of cheese discharged from the tower and sliced at the top. The cheese is initially lowered into the sleeve on a vertically retractable platform where it is clamped. The platform is removed and a cylindrical open top barrel is placed under the sleeve, the sleeve and cheese are partly inserted axially into the barrel, and the cheese is then unclamped and allowed to slide into the barrel. Although this apparatus has generally operated satisfactorily, variations in the moisture content of the cheese exiting the tower have resulted in inconsistent operation of this transfer device.

In U.S. Pat. No. 5,175,014, a method and apparatus are disclosed for the bulk packaging of cheese in a lined rectangular container in which a vertically movable lift device supports a false container bottom as cheese blocks placed thereon are lowered vertically until the container is filled. However, the cheese is supplied in smaller blocks which are intended to collate or consolidate under their own weight in the container to form, for example, a 640 lb. block.

Although vertical cheese towers have now been well accepted and are widely used in the industry, systems for handling, transferring and containerizing cheese being discharged from the tower have performed inconsistently or with only narrow ranges of capability. In particular, a system for processing both 640 lb. blocks and 500 lb. barrels in an efficient and effective manner has not been provided.

SUMMARY OF THE INVENTION

In accordance with the present invention, a system is provided which operates to effectively and efficiently containerize cheese from a vertical cheese tower in either large rectangular blocks (e.g. 640 lbs.) or large cylindrical barrel sizes (e.g. 500 lbs.). The system is adapted particularly to handle bulk cheese packaged in closed bottom cylindrical barrels for which an intermediate transfer process is used. Both cylindrical or rectangular blocks may also be directly packaged from the tower utilizing false bottom containers.

In accordance with one embodiment of the present invention, bulk cheese formed in a vertical cheese tower is containerized with a method comprising the steps of: lowering a selected length of cheese from the tower into an open top first container which has an open top tubular plastic liner positioned therein; sealing the open plastic liner; placing an inverted open top and closed bottom second container over the outside of the first container; inverting the containers and cheese; vertically separating the inverted first container from the upright second container to leave the sealed cheese therein; and, securing an enclosing lid on the second container. The first container is provided with a false bottom movable vertically inside an enclosing container outer wall, which may be cylindrical or rectangular, and the method comprises the steps of holding the false bottom in contact with the lower end of the cheese with a vertically reciprocable support extended through the first container held below, and retracting support through the container to effect said lowering step.

In one embodiment, the first container is mounted on or provided as an integral attachment to a track-supported wheel carriage, and the method includes the step of providing a closed loop track for the first container from the lower end of cheese tower. The method further includes the steps of reinverting the first container and carriage after the separating step, and returning the first container and carriage to the tower in position for a subsequent lowering step. The steps of lowering, sealing, placing and inverting may be performed at individual stations along the track. The steps of inverting, separating, and reinverting may be performed at the same station. The securing step is performed at an off-track station.

In a variant method of the subject invention, bulk cheese is containerized in a method comprising the steps of: providing a first container with an enclosing outer wall and a false bottom which is movable vertically inside the outer wall; positioning the first container below the lower end of a vertically formed cheese; positioning the false bottom of the container in contact with the lower end of the cheese on a reciprocal support which has been extended vertically through the container from below; lowering the support to bring the false bottom and a portioned length of cheese into the first container; placing an inverted open top second container over the first container; inverting the containers and the cheese therein; separating first container vertically from the cheese and the second container, leaving the cheese in the latter; and, closing the open top of second container to enclose the cheese therein. The method preferably includes the steps of lining the first container with a sleeve of sealable plastic material, and sealing the sleeve prior to the placing step. All steps preceding and including the lowering step may be performed vertically beneath the discharge end of a vertical cheese tower, and all steps thereafter may be performed in stations laterally displaced from the tower.

The method of the present invention may be applied broadly for containerizing bulk cheese formed in a vertical cheese tower and discharged from the lower end thereof, by applying the steps of: providing a first container which has an enclosing outer wall, an open top, and a false bottom which is movable vertically inside the outer wall; positioning the false bottom in operative supporting contact with the lower end of the cheese on a reciprocal support which has been extended vertically through the container from below; interposing a sealable plastic liner between the false bottom and the cheese; lowering the support to bring the false bottom, a portioned length of the cheese, and the interposed liner into the container; sealing the liner to enclose the cheese therein; placing a closure over the open top; inverting the container and cheese to expose the end opposite the closure; and, closing and securing said opposite end. In one embodiment, the step of placing a closure comprises placing an inverted open top second container over the first container, and including after the inverting step, the additional step of lifting the first container from the second container to leave the sealed cheese in the latter. In another embodiment, the step of placing an enclosure comprises attaching a first cover to the open top. In this embodiment, the closing and securing step comprises attaching a second cover to the first container over the false bottom.

BRIEF DESCRIPTION OF THE DRAWINGS

FIG. 11 is a sectional view taken on line 11—11 of FIG. 10.

FIG. 12 is a side elevation similar to FIG. 10 showing the apparatus in the inverted position.

FIGS. 13 and 14 are details of the barrel lift interface for the inverting station.

DETAILED DESCRIPTION OF THE PREFERRED EMBODIMENTS

Figure 1:
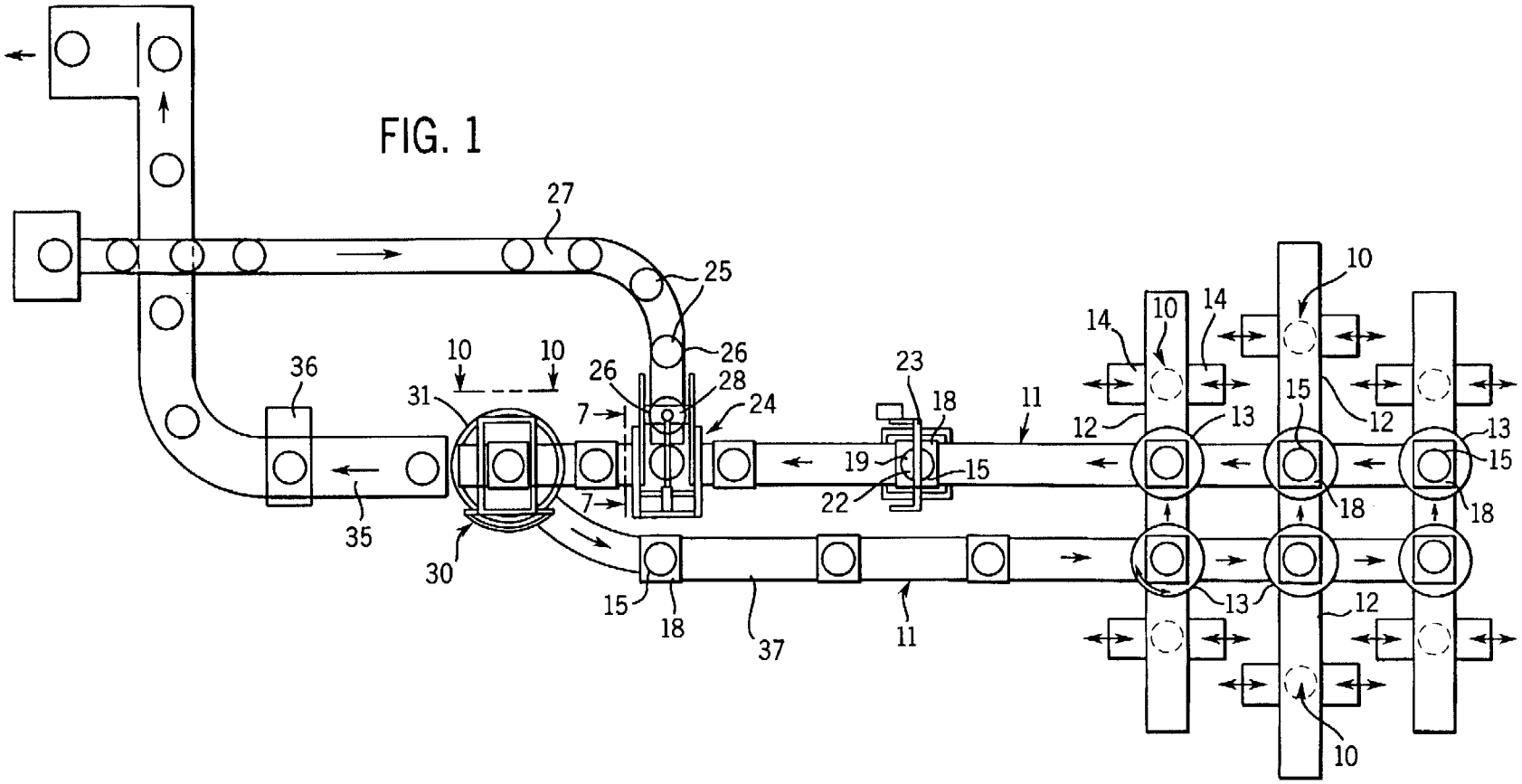
FIG. 1 is a top plan view showing a schematic representation of the cheese handling system utilizing the method of the present invention.

The system used to practice the method of the subject invention is shown incorporating six continuous vertical cheese formers or cheese towers 10. The cheese towers may be of the type described in U.S. Pat. No. 5,146,845 and are identical in construction and operation to one another. The towers are adapted to continuously form and discharge from their lower ends cheese of either circular or rectangular cross section. The system and method of operation to be described are operable to provide containerized bulk cheese of either cross sectional shape. In conjunction with one or more towers 10, the system utilizes a number of processing stations connected to the tower and to one another by a closed loop track 11. Each tower 10 is connected to the track loop 11 by a short perpendicular track section 12 with a connecting turntable 13 for carriage orientation as will be described below.

The method of the present invention is adapted to package and seal for shipment portioned lengths of cheese cut from a vertical cheese column produced in the tower 10. Typically, rectangular section lengths are cut to approximately 640 pound blocks and placed in corresponding rectangular containers, and circular section portions are cut into 500 pound pieces and containerized in corresponding cylindrical barrels. The lengths of bulk cheese are initially discharged into closed wall, open top containers which are provided with false bottoms. False bottoms facilitate loading and these first containers may comprise the shipping container or, in one variation of the method, the cheese may be transferred to a second container, typically a closed bottom steel barrel.

In a manner known in the art and described, for example, in the above identified patent, a continuous column of cheese formed in the tower 10 is restrained from vertical movement by a pair of laterally movable guillotine cutting knives 14 at the lower end of the tower. When the knives 14 are opened, the cheese column will descend vertically under its own weight. When a selectively portioned length of cheese has been discharged, the knives 14 are closed to sever the portioned length and support the cheese column extending above it. Because of the semi-fluid condition of the cheese, the portioned length is typically not self-supporting and must be substantially confined, both laterally and vertically through discharge and subsequent containerization.

A method will first be described for containerizing cylindrical 500 pound cheese sections in closed bottom barrels, typically made of steel, but which could be made of any suitable material. A barrel which has a closed fixed bottom, as opposed to a false bottom, does not lend itself to direct filling from the tower 10 in accordance with the present invention and its use, therefore, requires an intermediate transfer. Referring to FIGS. 3–6, a first container 15 comprising a barrel with a cylindrical side wall 16 has an open top and a false bottom 17. A number of circumferentially spaced keepers 29 are attached around an opening in the carriage to maintain the false bottom 17 in place as will be described in greater detail hereinafter. The side wall 16 and false bottom 17 are mounted on a wheeled carriage 18 which is adapted to move over the track 11, and feeder track section 12. The false bottom 17 is adapted to be moved vertically inside the cylindrical side wall 16 of the container 15. However, when in its normal supporting position in the bottom of the container 15, the peripheral edge of the false bottom 17 rests on the edge of a slightly smaller diameter bottom opening 38 in the carriage and is held there by the resilient keepers 29. In the disclosed embodiment, the keepers 29 comprise synthetic rubber-tired wheels 59 mounted on the bottom of the carriage 18 and extending through slots 69 in the lower edge of the side wall 16. With the carriage 18 positioned directly below the tower 10 with the first container 15 in direct axial alignment with the cheese column, a vertical lift mechanism 21 positioned directly under the carriage includes a support 20 which is moved upwardly through the open bottom of the carriage and into engagement with the false bottom 17, overcoming the bias of the keepers 29, and carrying the bottom 17 vertically upwardly to a position immediately beneath the closed cutting knives 14. When the knives are opened, the lower end of the cheese column is transferred to and supported directly on the false bottom 17. The lift mechanism 21 is retracted vertically to lower the support 20, false bottom 17 and cheese column until a length sufficient to fill the first container 15 has passed the knives 14. The knives are then closed to sever the portioned length of cheese from the column.

Preferably, to prepare the bulk cheese for shipping and storage, a sealable plastic liner 22 is placed over the false bottom 17 before the cheese column is lowered onto the false bottom and, as the portioned length of cheese is subsequently lowered into the container 15, the liner is pulled into the container along the inside of the cylindrical side wall 16 and the outside surface of the cheese 19. Preferably, the interior of the cylindrical side wall 16 is provided with a dimpled or other textured surface to prevent the plastic liner 22 from sticking to the side wall. This is important both for the initial loading of the cheese into the container and when the container 15 is subsequently removed, as will be described. When the false bottom 17 reaches the carriage 18, the cheese section 19, surrounded by an open ended liner 22 substantially fills the first container 15. The support 20 is lowered sufficiently to clear the carriage, the carriage is moved out from under the tower along the track section 12, turned 90° on the turntable 13, and directed along the track 11 to a vacuum sealing station 23.

The sealing station 23 operates in a conventional manner to evacuate air from the interior of the liner 22 and, while holding the vacuum, seal the open upper end of the liner to enclose cheese section 19 therein. The carriage 18, with the sealed cheese in the first container 15 thereon, is moved along the track to a barrel placer station 24.

Figure 7:
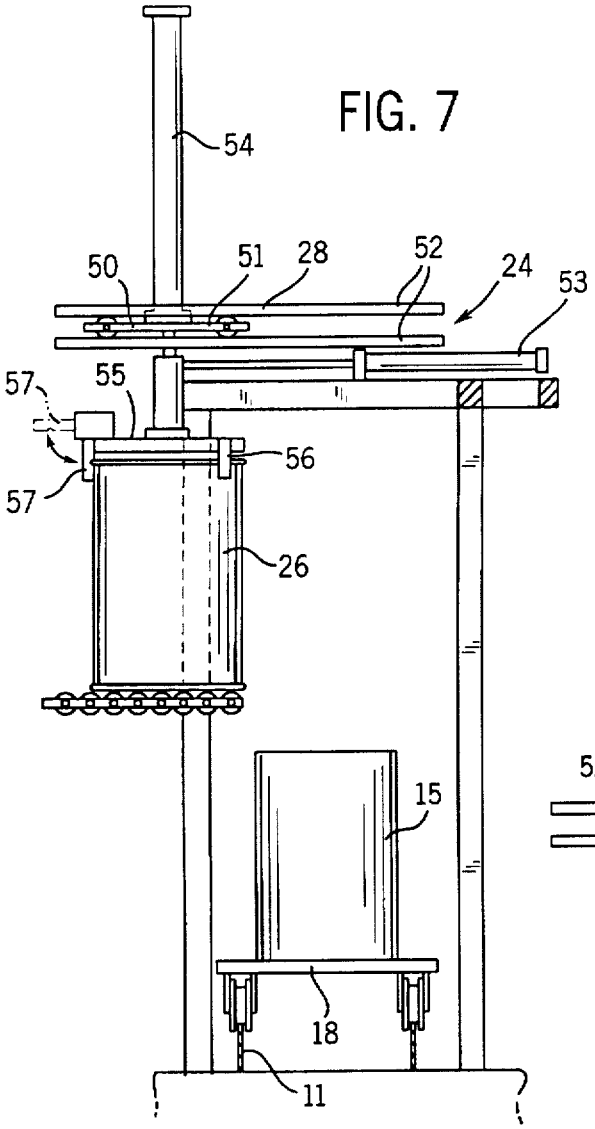
FIGS. 7 and 8 are details showing operation of the barrel placer station.
Figure 8:
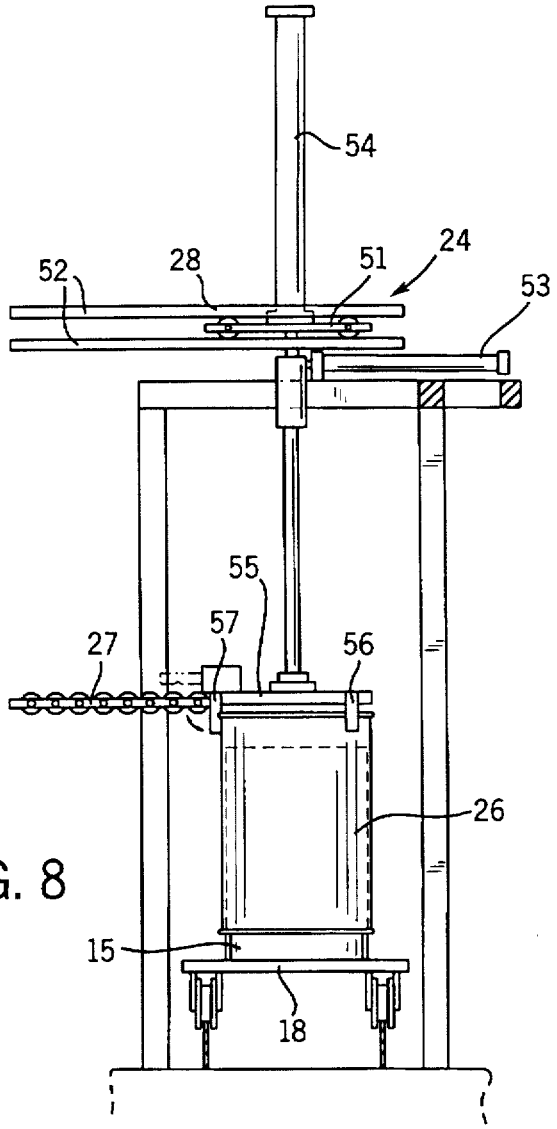
Figure 9:
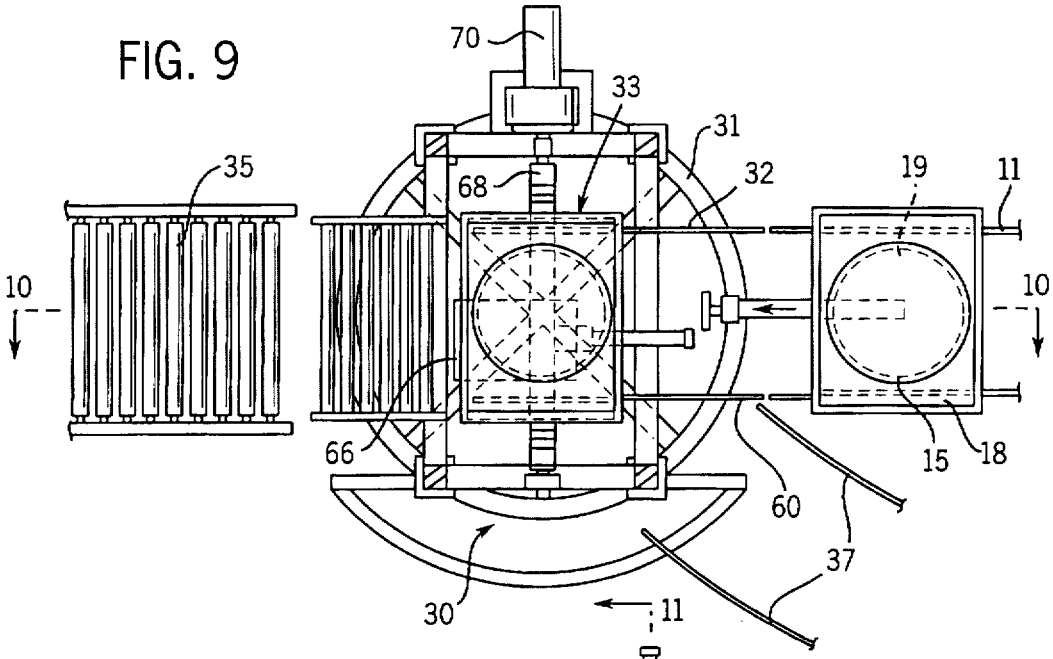
FIG. 9 is a top plan view of the inverting station of the apparatus of the present invention.

At the barrel placer station and referring also to FIGS. 7 and 8, a row of second containers 25, comprising inverted open top steel barrels 26 are moved along a feed conveyor 27 elevated above the track 11. Maintaining the barrels 26 in an inverted orientation on the feed conveyor also aids in preventing contamination which would more easily occur in an upright barrel where contaminants could enter the open top. With the barrels 26 on the feed conveyor 27 being in an inverted orientation, the open tops are on the bottom. A barrel transfer device 28 picks a single inverted barrel off the downstream end of feed conveyor 27 and lowers it vertically over the outside of the cylindrical side wall 16 of the first container 15, thereby completely enclosing the first container and sealing the cheese therein. As is best seen in FIGS. 7 and 8, a short path barrel shuttle 50 is mounted above the downstream end of feed conveyor 27. The shuttle carries the barrel transfer device 28 and includes a wheeled carriage 51 which travels horizontally between pairs of upper and lower confining tracks. Reciprocal movement of the carriage 51 is provided by carriage cylinder 53. A vertically operable barrel cylinder 54 is mounted on the carriage 51 and includes a barrel clamp mechanism 55 on the lower rod end of the cylinder. The clamp mechanism 55 includes a pair of stationary stops 56 which are positioned (FIG. 8) to engage the bottom side of the inverted steel barrel 26 as it reaches the end of feed conveyor 27. A rotary clamp 57 is then actuated to rotate downwardly, as shown in FIG. 7, to clamp the barrel against the stationary stops. The carriage cylinder 53 is then activated to carry the clamped barrel off the end of the feed conveyor to a position over the track 11 and directly above the carriage container 15 carrying the sealed cheese section 19. The barrel cylinder 54 is then extended to lower the steel barrel 26 over the outside of the cylindrical container 15. Rotary clamp 57 is then activated, as shown by the arrow in FIG. 8, to release the barrel and the clamp mechanism is lifted by retracting the barrel cylinder 54. The entire carriage supported assembly is then moved along the track to and into an inverting station.

The inverting station 30 is mounted for rotation on a vertical axis on a horizontal turntable 31. The turntable 31 includes suitable stub tracks 32 to accommodate movement of the carriage 18 into and out of the inverting station. The assembly of the wheeled carriage 18, containers 15 and 25, and the sealed cheese 19 therein, is secured in a rotary inverter 33 in the inverting station 30 and rotated 180° about a horizontal inverter axis. In the inverted position, the wheeled carriage 18 and attached first container 15 (including the cylindrical side wall 16 and false bottom 17) are lifted vertically by a cart lift device 34, causing the container side wall 16 to slide out from between the inside wall of the barrel and the outside surface of the sealed cheese. When the first container 15 has cleared the upper end of the cheese in the steel barrel 26 (which is now the open end of the barrel 26 because of its inversion), the barrel is pushed out of the inverting station 30 onto a discharge conveyor 35 which carries the cheese-filled barrel to a lid and band station 36 which is off-track with respect to the track loop 11. In station 36, a steel lid is placed on and sealed to the open end of the barrel 26 and the cheese is ready for shipment and/or storage.

After the barrel 26 has been discharged from the inverting station 30, the carriage 18 and attached first container 15 are lowered by reversing the cart lift device 34 and then rotated 180° on the rotary inverter 33 to return the assembly to its original upright position supported on the stub tracks 32. The inverting station horizontal turntable 31 is rotationally indexed approximately 45° and the carriage 18 and first container 15 are moved onto a return section 37 of the loop track 11 for return to the tower area.

A detailed description of the construction and operation of the inverting station 30 will now be provided with particular reference to drawing FIGS. 9–18. The carriage 18 is moved along a portion of track 11 and onto the stub tracks 32 on the horizontal turntable 31. The stub tracks 32 include an infeed section 60 (FIGS. 9 and 10) which rotate with the turntable, but are fixed in a horizontal orientation. The carriage 18 moves over the infeed section 60 and onto a center section 61 of the stub track which also forms the base of the rotary inverter 33. The center section 61 of the stub track is attached to the lower portion of a carriage support frame 62 which also includes a pair of laterally spaced vertical supports 63. Approximately midway along the length of each vertical support is attached a horizontal retaining bar 64. As the carriage 18 rolls onto the center stub track section 61, the lateral edges of the carriage platform 65 pass under the retaining bars 64, as may be seen in FIG. 11. A vertical stop 66 at the downstream end of the center stub track section 61 halts the movement of the carriage in a position centered vertically on the turntable 31.

The carriage support frame 62 is mounted for limited vertical sliding movement within the main inverter frame 68. Inverter frame 68 is rotatably mounted on a horizontal axis for reciprocal 180° rotation powered by an inverter drive 70. Carriage support frame 62 is mounted to slide along a pair of vertical tracks 67 mounted on opposite sides of the main inverter frame 68. Each of the vertical supports 63 of the support frame includes upper and lower pairs of cam wheels 71 mounted to capture the vertical tracks 67 so the support frame 62 can move vertically along the tracks in a manner to be described below.

Figure 10:
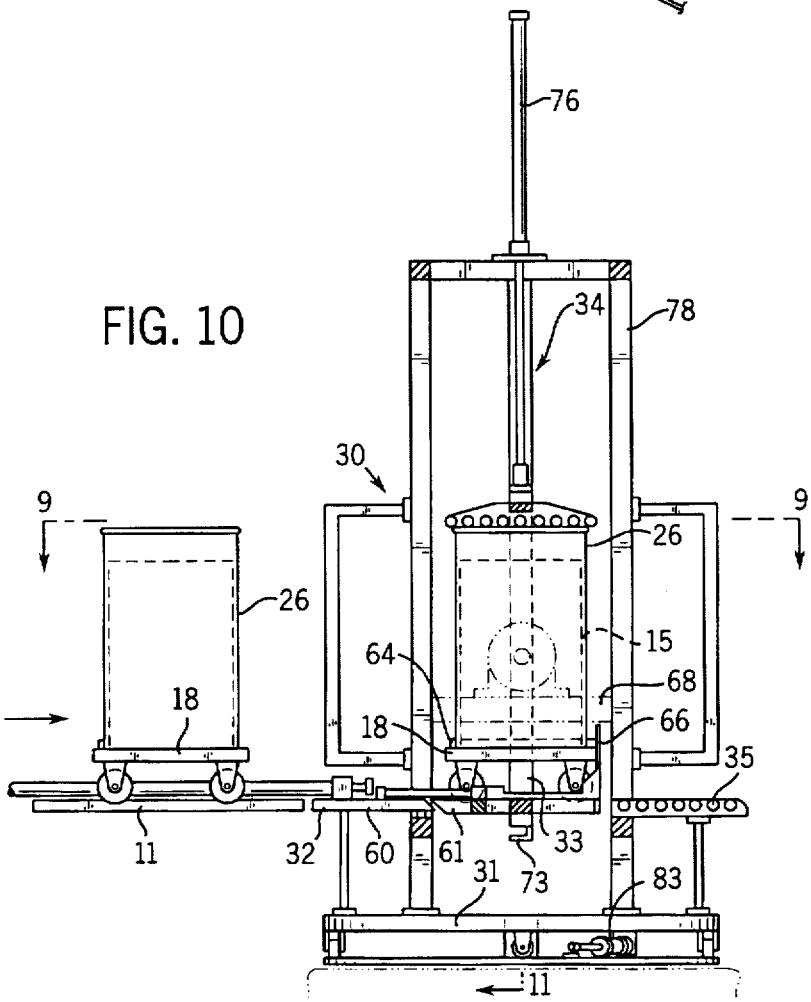
FIG. 10 is a side elevation of the apparatus shown in FIG. 9.

In the incoming carriage position, shown in FIGS. 10 and 11, the carriage support frame 62 (and therefore the carriage with its integral first container 15, the cheese section 19 loaded therein, and the inverted steel barrel 26 previously placed thereover) is prevented from sliding vertically downwardly along the tracks 67 by a pair of rotatable power clamps 72. As shown in FIG. 11, the power clamps are rotated to a horizontal position in which they engage the lower end of the support frame 62 to hold it and the carriage in the infeed position with the center stub track section 61 horizontally aligned with the infeed track section 60, as described.

At the bottom of the carriage support frame 62, there is attached a lift bracket 73 defining a flanged U-shaped slot which opens in the direction of inverter frame rotation. When the carriage/cheese/barrel assembly is positioned to be inverted, the inverter drive 70 is operated to rotate the inverter frame 68 from the FIG. 10 position to the FIG. 12 position. As the frame 68 approaches its fully inverted position, the lift bracket 73 engages a flanged end 74 on the extended rod end 75 of a vertical lift cylinder 76. The details of the engagement between the lift bracket 73 and the flanged end of the cylinder rod 75 are shown in FIGS. 13 and 14. The vertical lift cylinder 76 is mounted to the top of the main frame 77 between opposite main side frame members 78.

Figure 16:
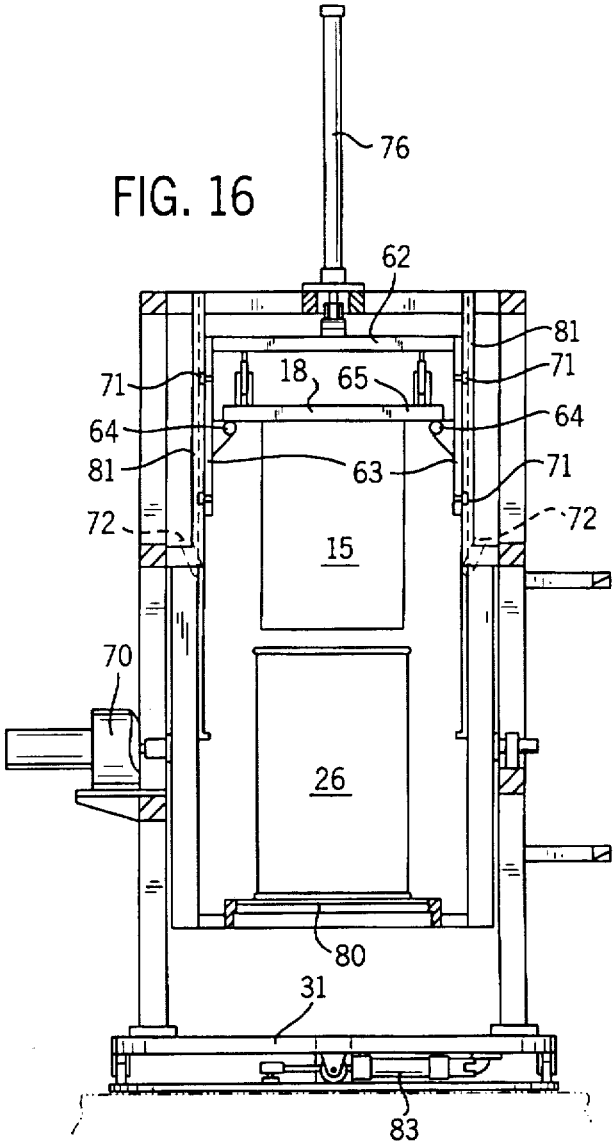
FIG. 16 is an end elevation of the apparatus shown in FIG. 15.
Figure 15:
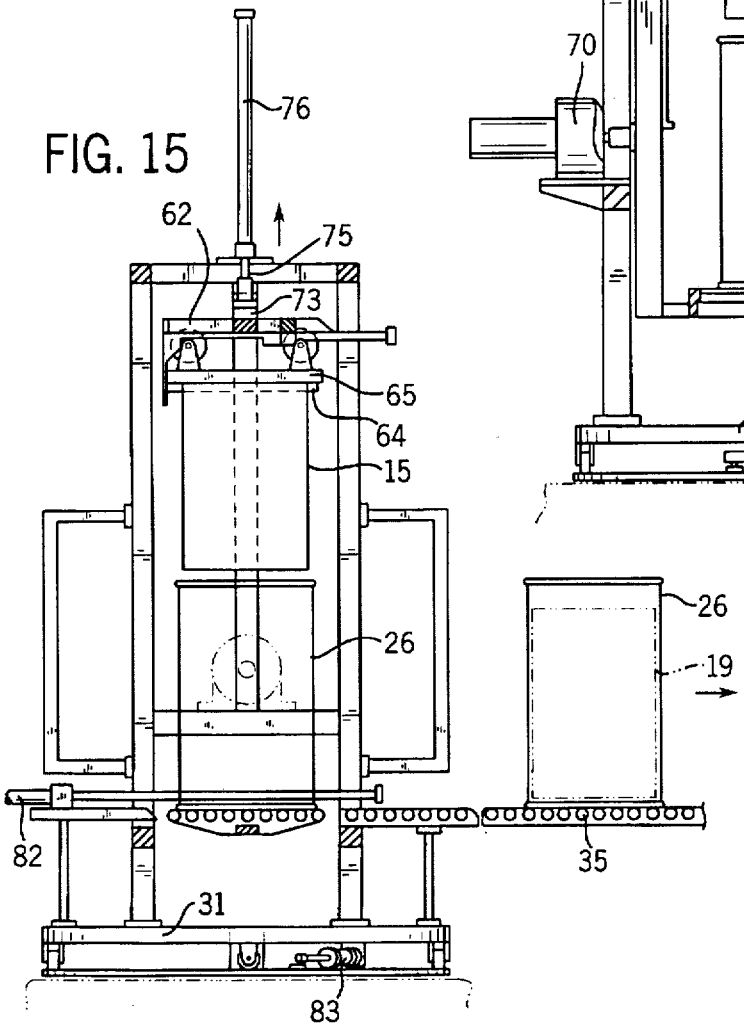
FIG. 15 is a side elevation similar to FIG. 12 showing removal of the inverted carriage container.

Referring to FIGS. 12, 15 and 16, the inverted carriage is supported vertically by the carriage platform 65 resting on the retaining bars 64. The steel barrel 26, which is now in an upright position is supported on an inverter frame cross member which comprises a short roller conveyor section 80. The power clamps 72, which are now at the top of the inverter frame 68, are activated to rotate to the open position (FIG. 16) and the vertical lift cylinder 76 is retracted to raise the carriage support frame 62, bringing the carriage 18 and integral first container 15 along with it. Attached to each main side frame member 78 is a vertical track extension 81 which is aligned vertically with one of the vertical tracks 67 along which the carriage support frame 62 moves. With the power clamps 72 open, the carriage support frame 62 (and attached carriage 18) passes from the vertical tracks 67 onto the vertical track extensions 81 until the vertical lift cylinder 76 is nearly fully retracted, as shown in FIGS. 15 and 16. This action causes the cylindrical first container 15 on the carriage 18 to be withdrawn from its position between the inside wall of the steel barrel 26 and the plastic liner enclosing the cheese section 19. The resilient keepers 29 hold the false bottom 17 in place in the inverted container 15. The sealed cheese is thus fully contained within the upright barrel 26. The roller conveyor section 80 supporting the barrel and cheese is aligned horizontally with the discharge conveyor 35. A long stroke discharge cylinder 82 mounted between the tracks 11 on the upstream side of the inverting station 30 is extended to push the barrel 26 onto the discharge conveyor 35 where it is conveyed to the lid and banding station 36.

Figure 17:
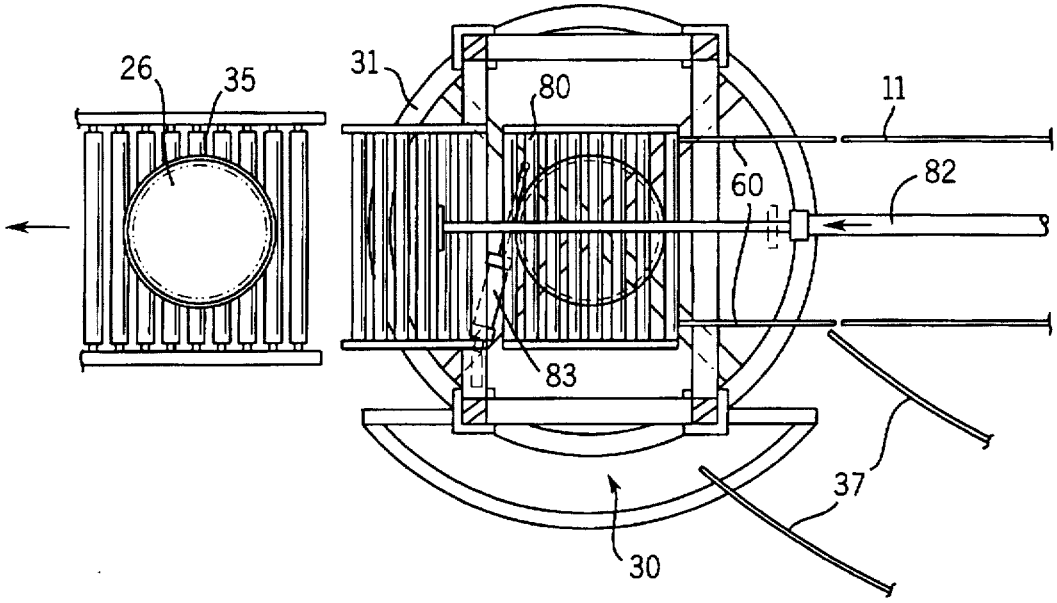
FIGS. 17 and 18 are top plan views similar to FIG. 9 showing respectively discharge of the filled container and the carriage container from the inverting station.
Figure 18:
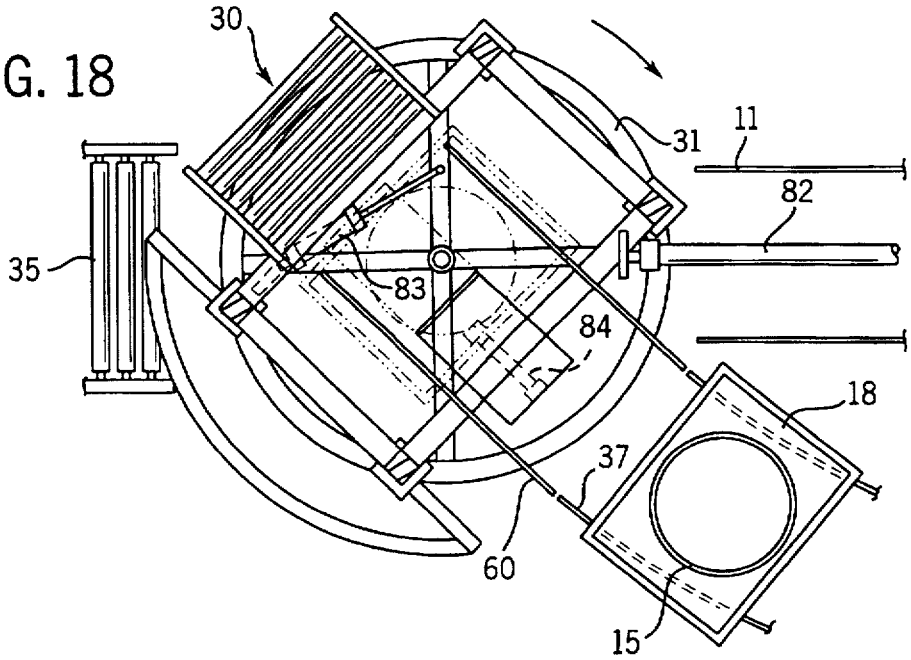

The vertical lift cylinder 76 is then extended to lower the carriage support frame along with the still inverted but now empty first container 15 to the lower position (FIG. 12), the inverter drive 70 is operated to turn the inverter frame 68 180° in the reverse direction to return the carriage support frame and carriage to the original upright position (FIG. 10). Referring to FIGS. 17 and 18, a turntable cylinder 83, interconnecting the fixed and rotatable portions of the horizontal turntable 31, is extended to rotate the inverter frame approximately 45° on a vertical axis to the FIG. 18 position to align the inverter track sections 60 and 61 with the carriage return track section 37. The empty carriage and container is then discharged from the inverting station onto the return track 37 in any convenient manner, such as by activating a short stroke cylinder 84 which engages a portion of the carriage and provides sufficient momentum to roll the carriage onto the return track section.

Figure 2:
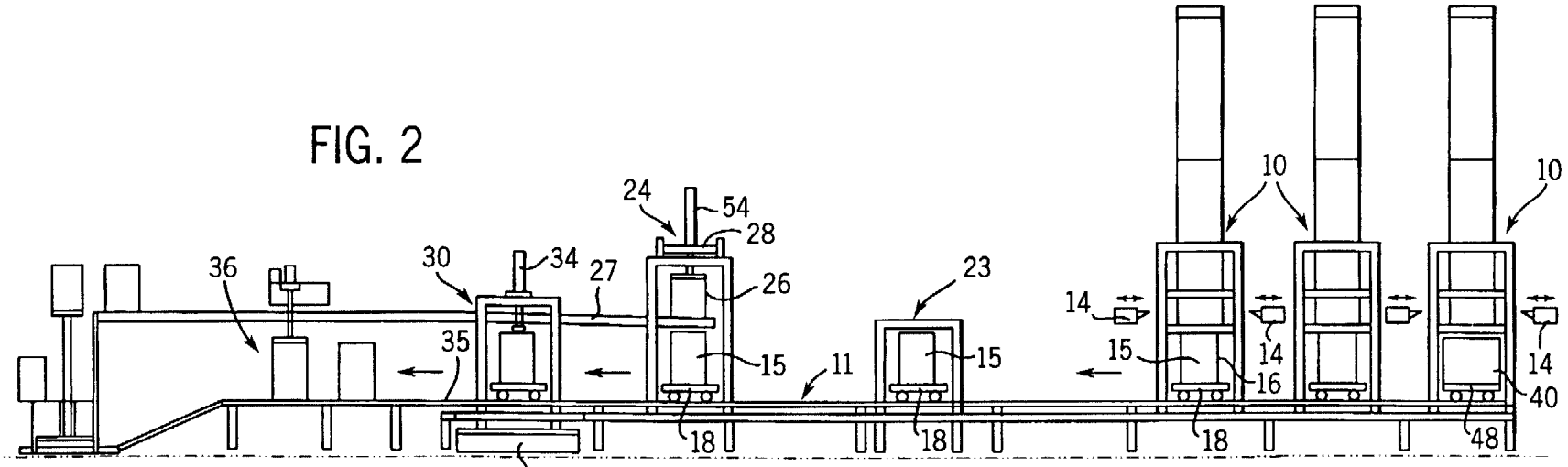
FIG. 2 is a schematic side elevation of the system shown in FIG. 1.
Figure 6:
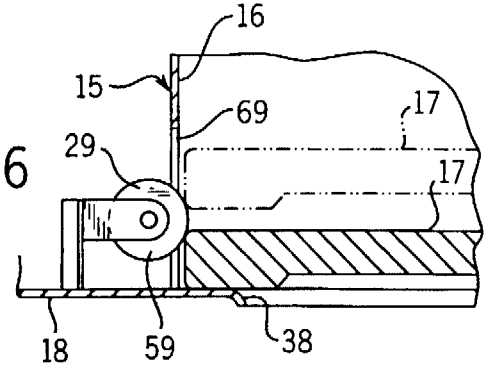
FIGS. 5 and 6 are details of the container carriage showing the retainer mechanism for the false bottom.
Figure 5:
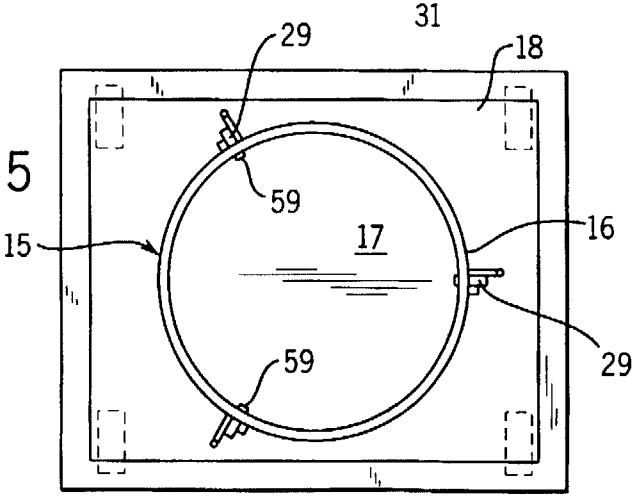
Figure 3:
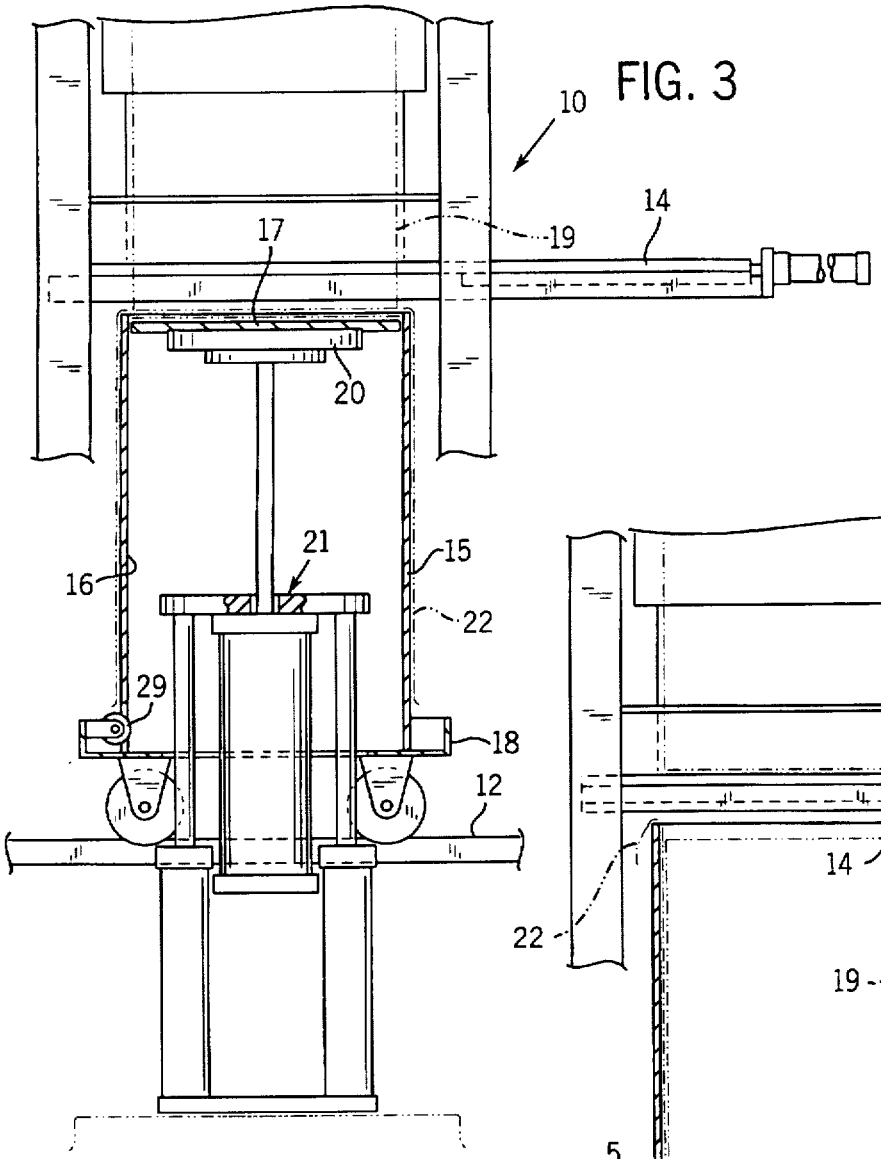
FIGS. 3 and 4 are details of the tower lift mechanism shown in its uppermost and lowermost vertical positions.
Figure 4:
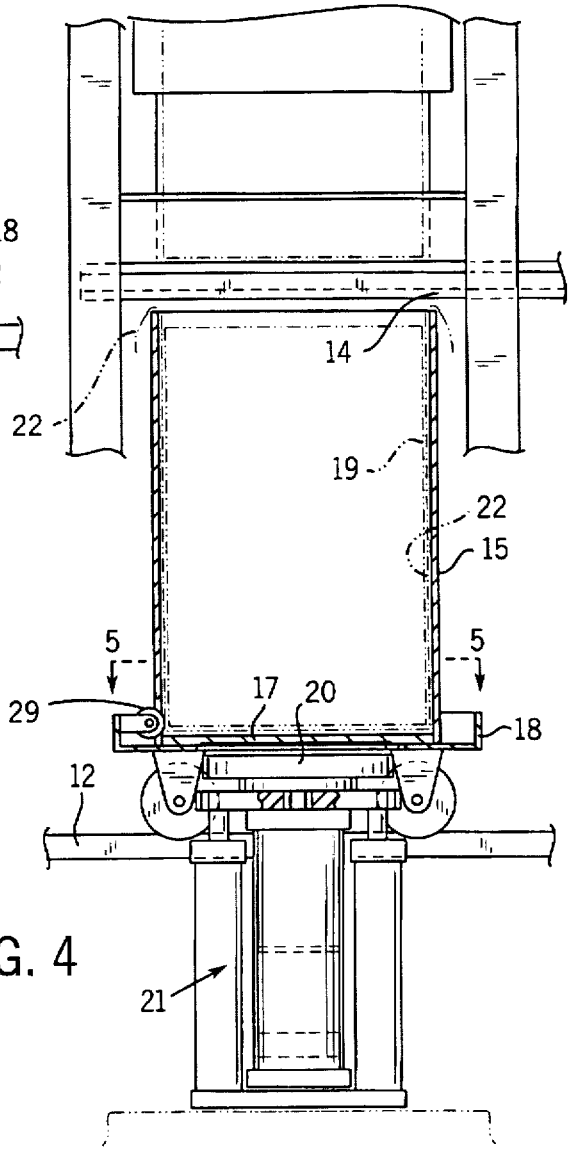
Figure 19C:
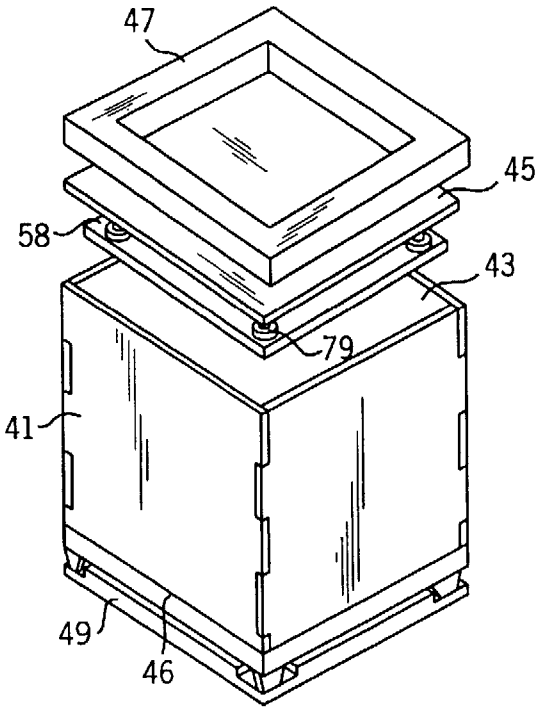
FIGS. 19A–19C shows details of a container used with an alternate embodiment of the invention.

In another embodiment of the method of the present invention, cheese may be unloaded from the tower 10 directly into the container in which the cheese is finally shipped and/or stored. For example, 640 pound rectangular blocks of cheese are typically packaged in a box made of wood, paperboard, fiber board, stainless steel, plastic or other suitable material. Referring again to the same schematic arrangements in FIGS. 1 and 2, and also to FIGS. 19A–19C, a rectangular packaging and shipping container 40 is positioned beneath the tower 10 in axial alignment with the vertical cheese column. The container 40 has a rectangular outer wall 41 and a false bottom 42 which is free to move vertically inside the outer wall. The top of the container 40 is completely open. However, as with the previously described embodiment, a suitable plastic liner 39, which is heat sealable or otherwise capable of being closed to seal the cheese, is placed within the outer wall and over the false bottom, or simply placed horizontally over the open outer wall and drawn into the container with the cheese as the container is filled. The rectangular container 40 and false bottom 42 are held for transport in a rectangular open framed box carriage 48 which is provided with track engaging wheels to operate over the track system, as the barrel carriage 18 previously described. The open frame of the box carriage 48 is rectangular in shape and sized to support the false bottom 42, but to allow the false bottom to be engaged and raised by the support 20 of the vertical lift mechanism 21, as previously described with respect to the cylindrical barrel carriage.

With the box carriage 48 and container 40 in position, the vertical lift mechanism 21 is activated to raise the support 20 into contact with the underside of the false bottom 42 and to continue to raise the same up to a position immediately below the closed cutting knives 14 at the bottom of the tower. The plastic liner 39 is resting on the upper surface of the false bottom 42. The cutting knives 14 are retracted laterally to open the bottom of the tower and allow the column of cheese to descend. In accordance with the apparatus described in the above identified U.S. Pat. No. 5,146,845, the tower is adapted to form and discharge a cheese column which is either circular in cross section or rectangular in cross section, the latter of course being utilized for the rectangular container 40. The cheese column, supported on the false bottom 42 is allowed to descend by reversing the lift mechanism 21 and moving the support 20 downwardly through the inside of the container 40. When a portioned length of cheese 43 sufficient to fill the container has been discharged, the vertical lift mechanism 21 is caused to pause in its descent and the cutting knives 14 are activated to cut the cheese column and reclose the bottom of the tower. The support on the vertical lift mechanism is retracted further downwardly to its full retracted position allowing the cheese 43 to be supported on the false bottom 42 resting on the frame of the wheeled box carriage 48. As previously described with the first embodiment, the liner 39 is also drawn into the container by the descending cheese and is interposed between the enclosing wall and bottom and the cheese section contained therein. The liner is, of course, sized to extend outwardly above the container a distance sufficient to allow the liner to completely enclose the cheese 43 and to be sealed.

The wheeled carriage 48 is pushed out from under the tower along the track section 12, turned on horizontal turntable 13, and moved along the track 11 to the sealing station 23. Here the liner 39 is sealed in the manner previously described, utilizing a conventional vacuum sealing apparatus known in the art. The sealed cheese 43 in the container 40 is moved downstream along the track 11 and through the barrel placer station 24 which is not utilized in the method of this embodiment.

Figure 19B:
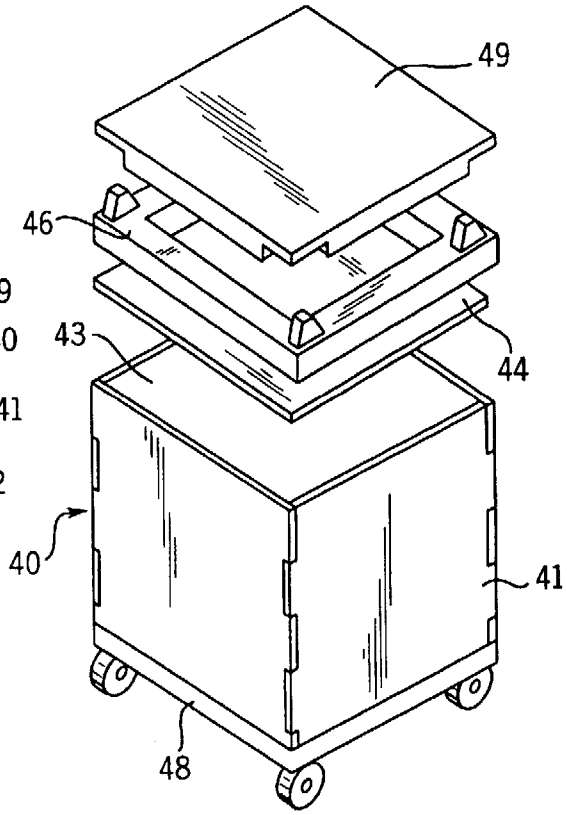
Figure 19A:
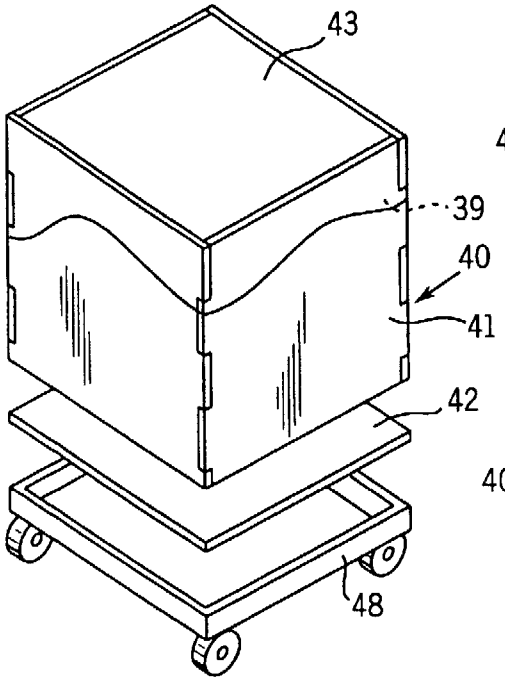

However, referring to FIG. 19B, an enclosing cover 44 must be placed on the upper edge of the outer wall 41 of the container. Preferably, the cover 44 eventually becomes the bottom of the container (as will be described) and is provided with a conventional skid frame 46 which allows the container to be moved with conventional material handling equipment. The facilitate sliding movement of the container on the skid frame 46 (after it is inverted as will be discussed), a transport pad 49 is placed atop the skid frame. The transport pad includes recessed corners for receipt of the feet of the skid frame. The cover 44 may be placed automatically in a separate station (not shown) or in a modification of the barrel placer station 24. The cover 44, skid frame 46 and transport pad 49 may be also placed manually.

With the cover, skid frame and pad attached, the container 40 is moved into the inverting station 30 where it is rotated 180° on the rotary inverter 33. In this position, the box carriage and false bottom 42 are now on top. The box carriage 48 is lifted vertically by the cart lift device 34 in the same manner previously described with respect to the wheeled carriage 18. The false bottom 42 is temporarily left in place a top the inverted container 40. The inverted container 40 is moved out of the inverting station 30 and onto the discharge conveyor 35 by discharge cylinder 82. It is directed along the conveyor and into the lid and band station where the false bottom 42 is removed and returned to the loop track 11 with the box carriage 48. An inner cover 58 is placed over the sealed cheese in the container 40 and an outer top cover 45 is placed thereover. Spring means 79 may be placed between the inner cover 58 and top cover 45 to place the cheese in compression. A protective top frame 47 is added and the entire container suitably banded in a conventional and well known manner for shipment and/or storage. The lid and band station 36 may also be provided with a compression device which may be needed to push the sealed cheese 19 or 43 fully into the container before the lid or top cover is applied.

The method of the embodiment just described may be utilized as well to containerize cylindrical cheese sections in corresponding cylindrical barrels. Such cylindrical barrels are provided with false bottoms and the entire method is otherwise exactly as just described with respect to the rectangular container 40.

We claim:

1. A method for containerizing bulk cheese formed in a vertical cheese tower comprising the steps of:

(1) lowering a selected length of the lower end of the cheese from the tower into an open top first container having an open top tubular plastic liner therein;

(2) sealing the top of the plastic liner;

(3) placing an inverted open top, closed bottom second container over the outside of the first container;

(4) inverting the container and cheese;

(5) vertically separating the inverted first container from the upright second container to leave the sealed cheese therein; and, (6) securing an enclosing lid on the second container.

2. The method as set forth in claim 1 wherein said first container includes a cylindrical enclosing outer wall and a false bottom movable vertically inside the outer wall; and comprising the steps of:

(1) holding the false bottom in contact with the lower end of the cheese with a vertically reciprocable support extending through the first container from below; and, (2) retracting the support through the container to effect said lowering step.

3. The method as set forth in claim 1 wherein the first container is mounted on a track-supported wheeled carriage, and including the step of providing a closed loop track for the first container from the lower end of the cheese tower.

4. The method as set forth in claim 3 including the steps of:

(1) reinverting the first container and carriage after the separating step; and, (2) returning the first container and carriage to the tower in position for a subsequent lowering step.

5. The method as set forth in claim 4 wherein said steps of lowering, sealing, placing and inverting are performed at individual stations along the track.

6. The method as set forth in claim 5 wherein said steps of inverting, separating and reinverting are performed at the same station.

7. The method as set forth in claim 6 wherein said securing step is performed at an off-track station.

8. A method for containerizing bulk cheese comprising the steps of:

(1) providing a first container having an enclosing outer wall and a false bottom movable vertically inside the outer wall;

(2) positioning the first container below the lower end of a vertically formed cheese;

(3) positioning the false bottom in contact with the lower end of the cheese on a reciprocable support extended vertically through the container from below;

(4) lowering the support to bring the false bottom and a portioned length of the cheese into the first container;

(5) placing an inverted open top second container over the first container and the length of cheese therein;

(6) inverting the containers and cheese;

(7) vertically separating the first container from the cheese and the second container so the cheese remains in the second container; and, (8) closing the open top of the second container to enclose the cheese therein.

9. The method as set forth in claim 8 including the steps of:

(1) lining the first container with a sleeve of sealable plastic material; and, (2) sealing the sleeve prior to the placing step.

10. The method as set forth in claim 9 wherein all steps preceding and including said lowering step are performed vertically beneath the discharge end of a vertical cheese tower, and all steps thereafter are performed in stations laterally displaced from said tower.

11. A method for containerizing bulk cheese formed in a vertical cheese tower and discharged from the lower end thereof, said method comprising the steps of:

(1) providing a first container having an enclosing outer wall, an open top, and a false bottom movable vertically inside the outer wall;

(2) positioning the false bottom in operative supporting contact with the lower end of the cheese on a reciprocable support extended vertically through the container from below;

(3) interposing a sealable plastic liner between the false bottom and the cheese;

(4) lowering the support to bring the false bottom, a portioned length of the cheese, and the interposed liner into the container;

(5) sealing the liner to enclose the cheese therein;

(6) placing a closure over the open top;

(7) inverting the container and cheese to expose the end opposite the closure; and, (8) closing and securing said opposite end.

12. The method as set forth in claim 11 wherein the step of placing a closure comprises placing an inverted open top second container over the first container, and including after the inverting step, the additional step of lifting the first container from the second container to leave the sealed cheese in the latter.

13. The method as set forth in claim 11 wherein the step of placing a closure comprises attaching a first cover to said open top.

14. The method as set forth in claim 13 wherein said closing and securing step comprises attaching a second cover to said first container over the false bottom.

15. An apparatus for containerizing bulk cheese formed in a vertical cheese tower and discharged from the lower end thereof, said apparatus comprising:

a first container having an enclosing outer wall, an open top, and a false bottom movable vertically inside the outer wall;

a sealable plastic liner interposed between the false bottom and the lower end of the cheese;

means for positioning the false bottom in operative supporting contact with the lower end of the cheese on a reciprocable support extendable vertically through the container from below and for lowering the support to bring the false bottom, a portioned length of the cheese, and the interposed liner into the container;

means for sealing the liner to enclose the cheese therein;

means for placing a closure over the open top;

means for inverting the container and cheese to expose the end opposite the closure; and, means for closing and securing said opposite end.

16. The apparatus as set forth in claim 15 wherein the interior surface of the enclosing outer wall of said first container is provided with a textured surface to reduce sliding friction between said surface and the plastic liner.

17. The apparatus as set forth in claim 16 wherein said textured surface is dimpled.

18. An apparatus for containerizing bulk cheese formed in a vertical cheese tower and discharged from the lower end thereof, said apparatus comprising:

a container having an enclosing outer wall, an open top, and a false bottom movable vertically inside the outer wall;

a vertical lift mechanism below the tower for positioning the false bottom in operative supporting contact with the lower end of the cheese on a reciprocable support extendable vertically through the container from below and for lowering the support to bring the false bottom and a portioned length of the cheese into the container;

a barrel placing device operative to place an inverted open top barrel over the open top of the container to enclose said container in the barrel;

an inverting device operative to invert the container, cheese and barrel and to lift the container from the barrel thereby transferring the cheese to the barrel;

a closing device for placing and securing a closure lid on the open top of the barrel.

19. The apparatus as set forth in claim 18 including a track interconnecting the vertical lift mechanism, the barrel placing device and the inverting device, and wherein said container includes an integral wheeled carriage operable on said track.

20. The apparatus as set forth in claim 19 wherein said barrel placing device comprises:

a horizontal feed conveyor positioned above the track for delivering a plurality of inverted barrels serially into said placing device;

a barrel shuttle adapted to grasp the downstream-most barrel from the feed conveyor and carry the barrel horizontally to a placing position vertically above the container carriage; and, a vertically reciprocable barrel placer on said shuttle adapted to lower the barrel onto the container.

21. The apparatus as set forth in claim 19 wherein said inverting device comprises:

an inverted frame aligned with the track and adapted to receive therein a container and carriage;

a drive operable to rotate the inverter frame on a horizontal axis;

a carriage support frame within said inverter frame and rotatable therewith, said support frame including a retainer device adapted to hold the carriage during rotation between an upright carriage position and an inverted carriage position, and said support frame mounted for vertical movement with respect to said inverter frame in the inverted carriage position; and, a carriage lift operable in response to inverter frame rotation to the inverted carriage position to lift the support frame to a raised position and withdraw the carriage and container from the upright barrel.

22. The apparatus as set forth in claim 21 including a discharge device operable to move the barrel out of the inverting device while the carriage is in the raised position.

23. The apparatus as set forth in claim 21 including resilient keeper means attached to the carriage and providing biasing engagement with the edge of the false bottom for retaining said false bottom in place when the carriage and container are moved to the inverted and raised positions.

24. The apparatus as set forth in claim 23 wherein said keeper means comprises resilient wheels extending through slots in the outer wall of the container.

* * * * *